US008152208B2

(12) United States Patent
Varney et al.

(10) Patent No.: US 8,152,208 B2
(45) Date of Patent: Apr. 10, 2012

(54) PANEL LOCK

(75) Inventors: Jim R. Varney, Maynard, MA (US); Bryan R. Hotaling, Harvard, MA (US); John MacNeill, Acton, MA (US)

(73) Assignee: Cosco Management, Inc., Wilmington, DE (US)

( * ) Notice: Subject to any disclaimer, the term of this patent is extended or adjusted under 35 U.S.C. 154(b) by 356 days.

(21) Appl. No.: 12/427,514

(22) Filed: Apr. 21, 2009

(65) Prior Publication Data

US 2010/0264675 A1 Oct. 21, 2010

(51) Int. Cl.
*E05C 3/16* (2006.01)
*E05C 19/18* (2006.01)

(52) U.S. Cl. . 292/227; 292/198; 292/288; 292/DIG. 37; 70/85

(58) Field of Classification Search ..... 292/60–64, 292/198, 227, 288, DIG. 37; 70/85
See application file for complete search history.

(56) References Cited

U.S. PATENT DOCUMENTS 298,964 A * 5/1884 Franke et al. ..... 292/297
1,003,642 A * 9/1911 Mulholland ..... 292/61
2,953,012 A 9/1960 Davis
3,065,619 A 11/1962 Coss
3,387,873 A 6/1968 Prosser et al.
3,437,365 A * 4/1969 Zadanoff et al. ..... 292/202
3,689,718 A 9/1972 Gorsuch
3,973,420 A * 8/1976 Brady et al. ..... 70/78
4,074,545 A 2/1978 Case
4,199,237 A 4/1980 Savage
4,286,811 A 9/1981 Schantz
4,342,476 A 8/1982 Brown et al.
4,664,429 A 5/1987 Notaro et al.
4,718,705 A 1/1988 Case
4,995,650 A 2/1991 Schantz et al.
5,172,577 A 12/1992 Gibson
5,655,394 A 8/1997 DiRocco, Jr.
5,771,717 A 6/1998 Broker et al.
6,224,118 B1 * 5/2001 Ashford ..... 292/202
6,272,890 B1 8/2001 Huston
6,428,060 B1 * 8/2002 Metz ..... 292/227
6,568,226 B1 * 5/2003 Ramsauer ..... 70/127
6,695,507 B1 * 2/2004 Waguespack et al. ..... 400/693
6,840,553 B2 1/2005 Dirnberger
6,874,825 B1 * 4/2005 Rauner ..... 292/61
7,313,937 B2 1/2008 Straka, Jr.

* cited by examiner

*Primary Examiner* — Carlos Lugo
(74) *Attorney, Agent, or Firm* — Barnes & Thornburg LLP

(57) ABSTRACT

A panel lock includes a stationary support base adapted to mount to a frame of an article near a panel mounted on the article. The panel lock also includes a panel-movement blocker mounted to the stationary support base to block selectively movement of the panel from a closed position to an opened position at the option of a user.

27 Claims, 7 Drawing Sheets

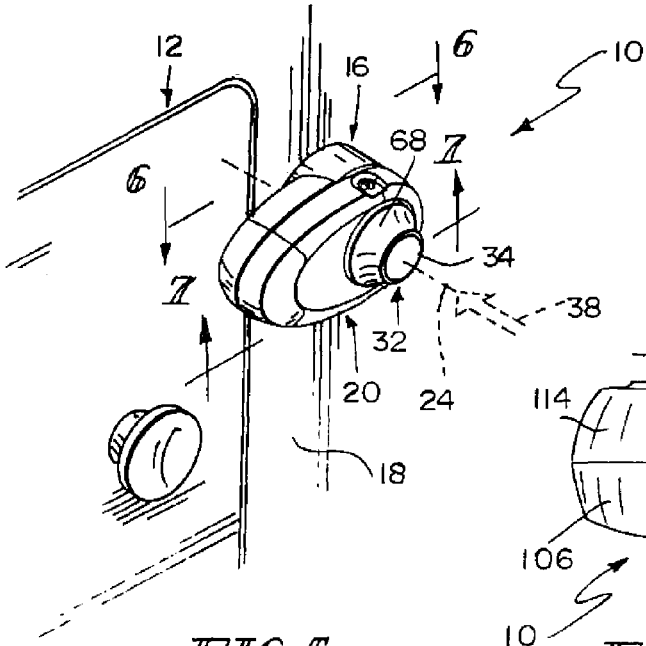
FIG. 5
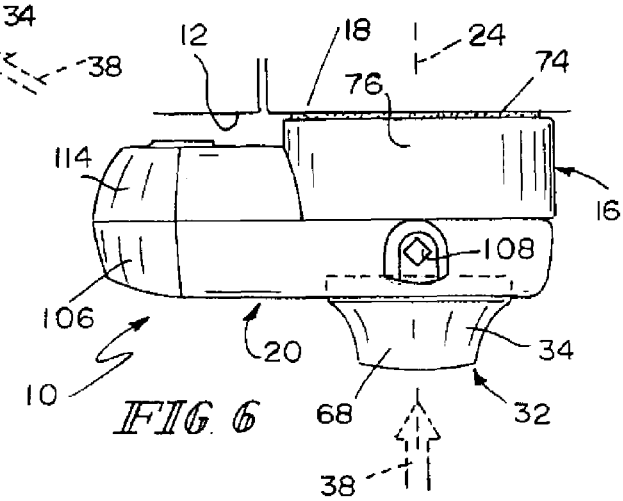
FIG. 6
FIG. 7
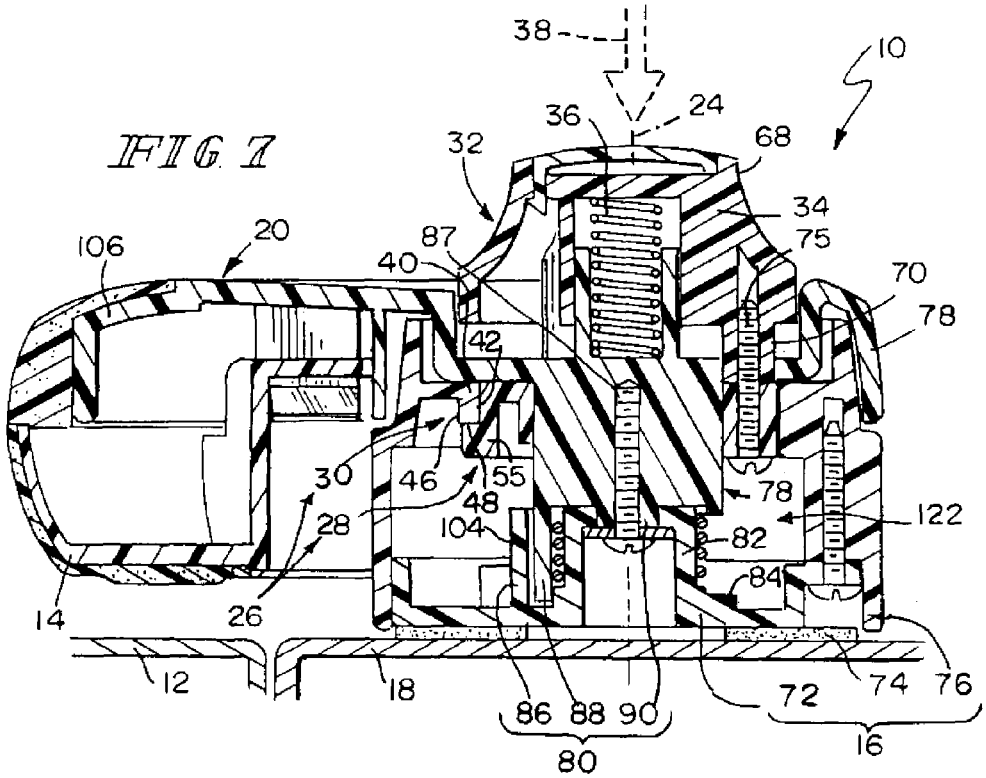

PANEL LOCK

BACKGROUND

The present disclosure relates to a panel, and in particular, to a panel covering an opening formed in an article. More particularly, the present disclosure relates to a lock configured to block movement of the panel between an opened position and a closed position.

SUMMARY

A panel lock in accordance with the present disclosure includes a stationary support base adapted for mounting on a frame of an article near a panel that is configured to close an opening formed in the article and a panel-movement blocker mounted on the stationary support base to block selectively movement of the panel from a closed position to an opened position. The panel-movement blocker is configured to rotate about a rotation axis between a panel-locking position wherein the panel is kept in the closed position and a panel-unlocking position wherein the panel is freed to move to the opened position.

In illustrative embodiments, the panel lock further includes a blocker-arm anchor configured to allow a user to control the movement of the panel-movement blocker. The blocker-arm anchor includes a rotation lock coupled to the panel-movement blocker for normally anchoring the panel-movement blocker to the stationary support base in a rotation-blocking position. The blocker-arm anchor also includes a rotation-lock actuator configured to provide means for moving the rotation lock from the rotation-blocking position to a rotation-unblocking position wherein the panel-movement blocker is free to rotate about the rotation axis in response to a user-applied rotation torque that is applied during movement of the panel-movement blocker from the panel-locking position to the panel-unlocking position.

In illustrative embodiments, the rotation lock includes a retainer-ring receiver formed in the stationary support base and a retainer ring arranged to mate with the retainer-ring receiver upon movement of the rotation lock to the rotation-blocking position. In illustrative embodiments, the user moves the retainer ring by engaging a rotation-lock release button included in the rotation-lock actuator. The rotation-lock release button is coupled to the panel-movement blocker and arranged to extend through an aperture formed in the panel-movement blocker to couple to the retainer ring. A button-return spring, also included in the rotation-lock actuator, is arranged to apply a biasing force to the rotation-lock release button to bias the rotation lock into the rotation-blocking position.

Additional features of the present disclosure will become apparent to those skilled in the art upon consideration of illustrative embodiments exemplifying the best mode of carrying out the disclosure as presently perceived.

BRIEF DESCRIPTION OF THE DRAWINGS

The detailed description particularly refers to the accompanying figures in which:

FIGS. 5-13 are a series of views showing an illustrative method by which a user may move the panel lock from the panel-locking position shown in FIGS. 1-5 to the panel-unlocking position shown in FIG. 11;

FIG. 5 is an enlarged perspective view of the lock of FIGS. 1-3 showing that the panel lock is coupled to an article frame and is configured in the panel-locking position and suggesting that a user pushes the rotation-lock release button inwardly by applying a button-actuation force, suggested by the phantom arrow, in an actuation direction along a rotation axis arranged to lie perpendicular to the frame;

FIG. 6 is a view taken from the perspective of line 6-6 of FIG. 5 showing that the panel lock is in the panel-locking position and showing that the panel lock status is communicated to the user by lock-status indicia visible through a lock-status window formed in the blocker-arm;

FIG. 7 is a sectional view taken along line 7-7 of FIG. 5 showing that the rotation-lock release button is arranged to extend through the blocker-arm and that the rotation-lock release button is coupled to a retainer ring of the rotation lock to move in an actuation direction (phantom arrow) relative to the blocker carrier and the blocker-arm as suggested in FIGS. 8-10 so that the blocker-arm may rotate freely about the rotation axis as suggested in FIGS. 11-13;

FIG. 8 is view similar to FIG. 5 showing a hand of a user applying the button-actuation force (solid arrow) along the rotation axis to the rotation-lock release button to move the retainer ring out of contact with a retainer-ring receiver formed in the blocker carrier so that the blocker-arm is free to rotate in the clockwise direction (phantom arrow) as shown in FIG. 11;

FIG. 9 is a view taken from the perspective of line 9-9 of FIG. 8 showing that the rotation-lock release button has been moved in the actuation direction relative to the blocker-arm in response to application of the button-actuation force;

FIG. 10 is a sectional view taken along line 10-10 of FIG. 8 showing that the rotation-lock release button has been moved in the actuation direction to cause the interconnected retainer ring to move out of contact with the retainer-ring receiver so that the blocker-arm may rotate freely as suggested in FIG. 11;

FIG. 11 is a view similar to FIG. 8 showing that the panel lock has been rotated in the clockwise direction to the panel-unlocking position in response to the user's hand applying a rotation force to the blocker-arm and showing that the panel has been moved to the opened position;

FIG. 12 is a view taken from the perspective of line 12-12 showing that the rotation-lock release button has remained in an actuated position during rotation of the blocker-arm and showing that panel can move freely past the blocker-arm;

FIG. 13 is a sectional view taken along line 13-13 of FIG. 11 showing that the blocker-arm rotation is stopped when an arm pivot included in the blocker-arm comes into contact with a blocker-stop tab formed in the carrier foundation thereby blocking further rotation of the blocker-arm in the clockwise direction;

DETAILED DESCRIPTION

Figure 1:
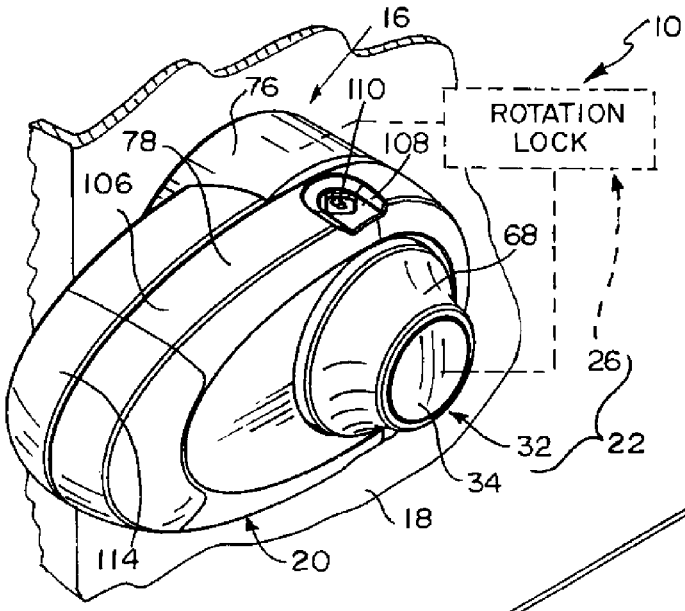
FIG. 1 is a perspective view of a panel lock for securing a panel in a closed position as suggested in FIGS. 2 and 3, the panel lock including a stationary support base, a blocker-arm mounted for rotation on the stationary support base, and a blocker-arm anchor including a rotation lock for normally anchoring the blocker-arm to the stationary support base and a rotation-lock release button that can be pushed inwardly to release the rotation lock so that the blocker-arm is free to rotate about a rotation axis relative to the stationary support base.
Figure 2:
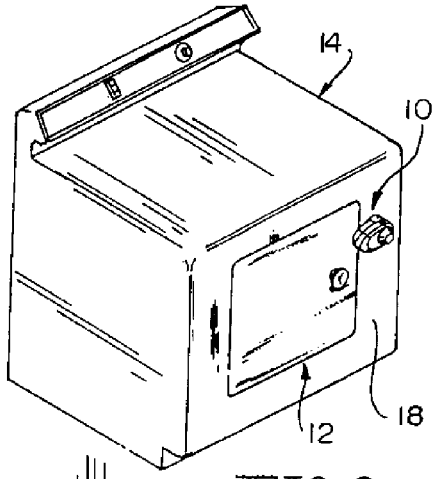
FIG. 2 is a reduced-size perspective view of the panel lock of FIG. 1 coupled, for example, to a clothing dryer frame to block the opening of a closed dryer door panel.

A panel lock 10, in accordance with the present disclosure, is shown in FIG. 1. Illustratively, lock 10 is mounted on an article frame 18 of an article 14 as shown in FIG. 2 to lock a panel 12. In one illustrative embodiment panel 12 is a dryer door configured to lie flush with a dryer frame as shown in FIGS. 1-13. In another illustrative embodiment, lock 10 may be reconfigured for use with a raised-face panel 126 which is a different type of dryer door as shown in FIGS. 14-18. An illustrative method for moving lock 10 from a panel locking position (FIGS. 1-3) to a panel-unlocking position (FIGS. 11-13) is shown in FIGS. 5-13.

Figure 3:
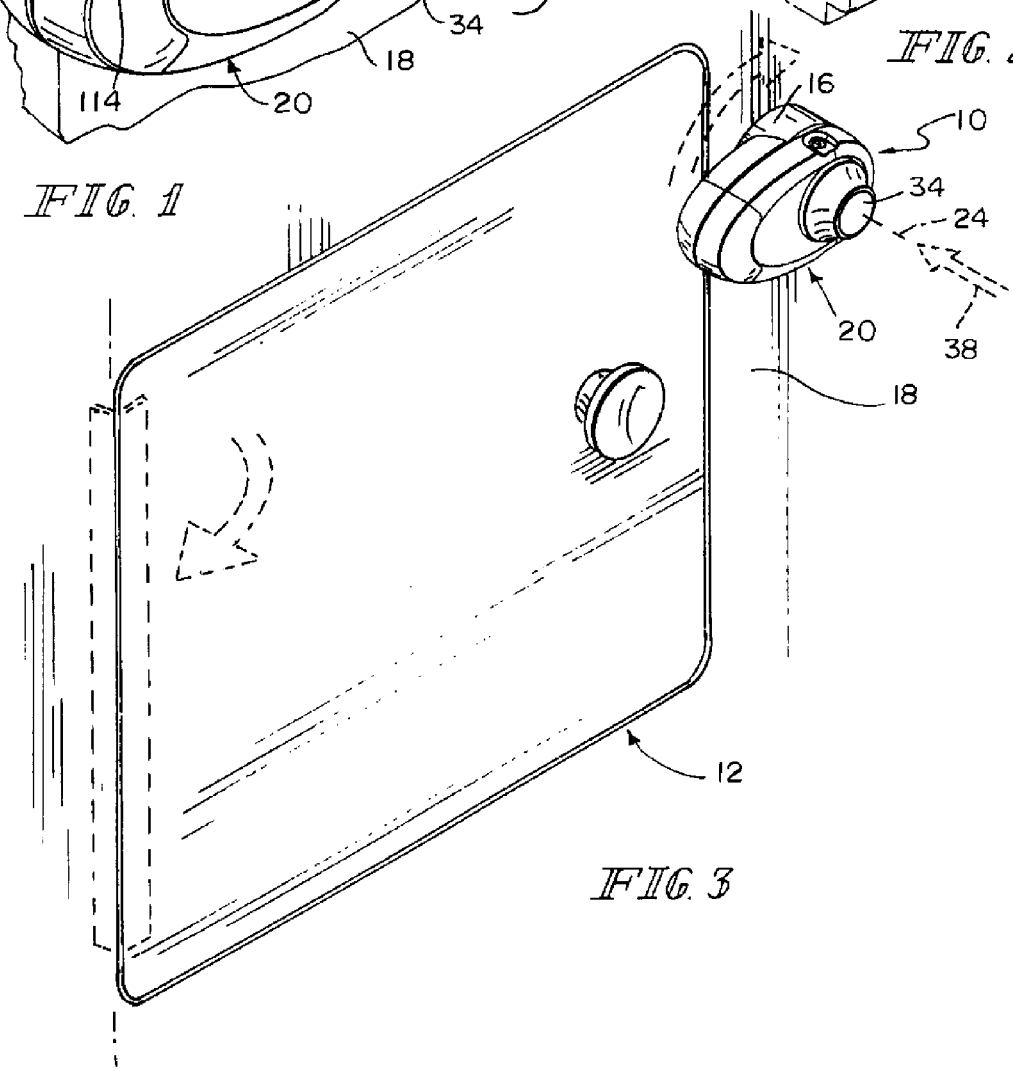
FIG. 3 is an enlarged perspective view of the panel lock of FIG. 2, suggesting that the dryer door panel may be moved to an opened position after the panel lock is moved from a panel-locking position to a panel-unlocking position, by an illustrative series of steps shown in FIGS. 5-13.
Figure 9:
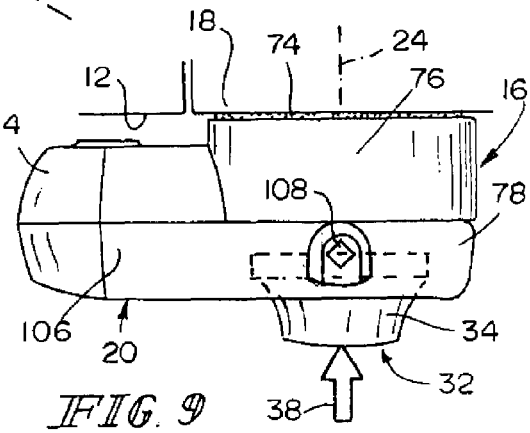
Figure 10:
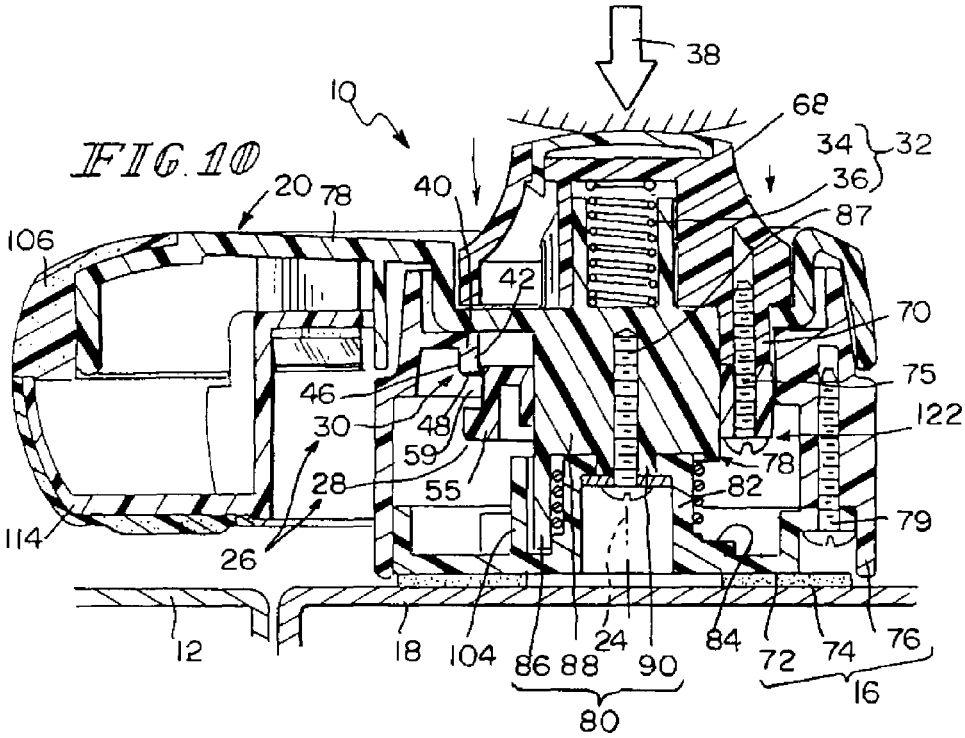

As shown in FIG. 1, a panel lock 10 comprises a blocker-support base 16, a panel-movement blocker 20, and a blocker-arm anchor 22. Blocker-support base 16 is adapted to mount on an article frame 18 in a stationary position near panel 12 as shown in FIG. 3. Panel-movement blocker 20 is mounted on blocker-support base 16 to rotate about a rotation axis 24. Panel-movement blocker 20 rotates about rotation axis 24 between a panel-locking position, as shown in FIGS. 1-3, 5-10, 15, and 18, wherein panel-movement blocker 20 is arranged to block movement of panel 12 to keep panel 12 in mating contact with article 14, and a panel-unlocking position, as shown in FIGS. 8-10, wherein panel-movement blocker 20 is arranged to allow movement of panel 12 out of mating contact with article 14.

Figure 4:
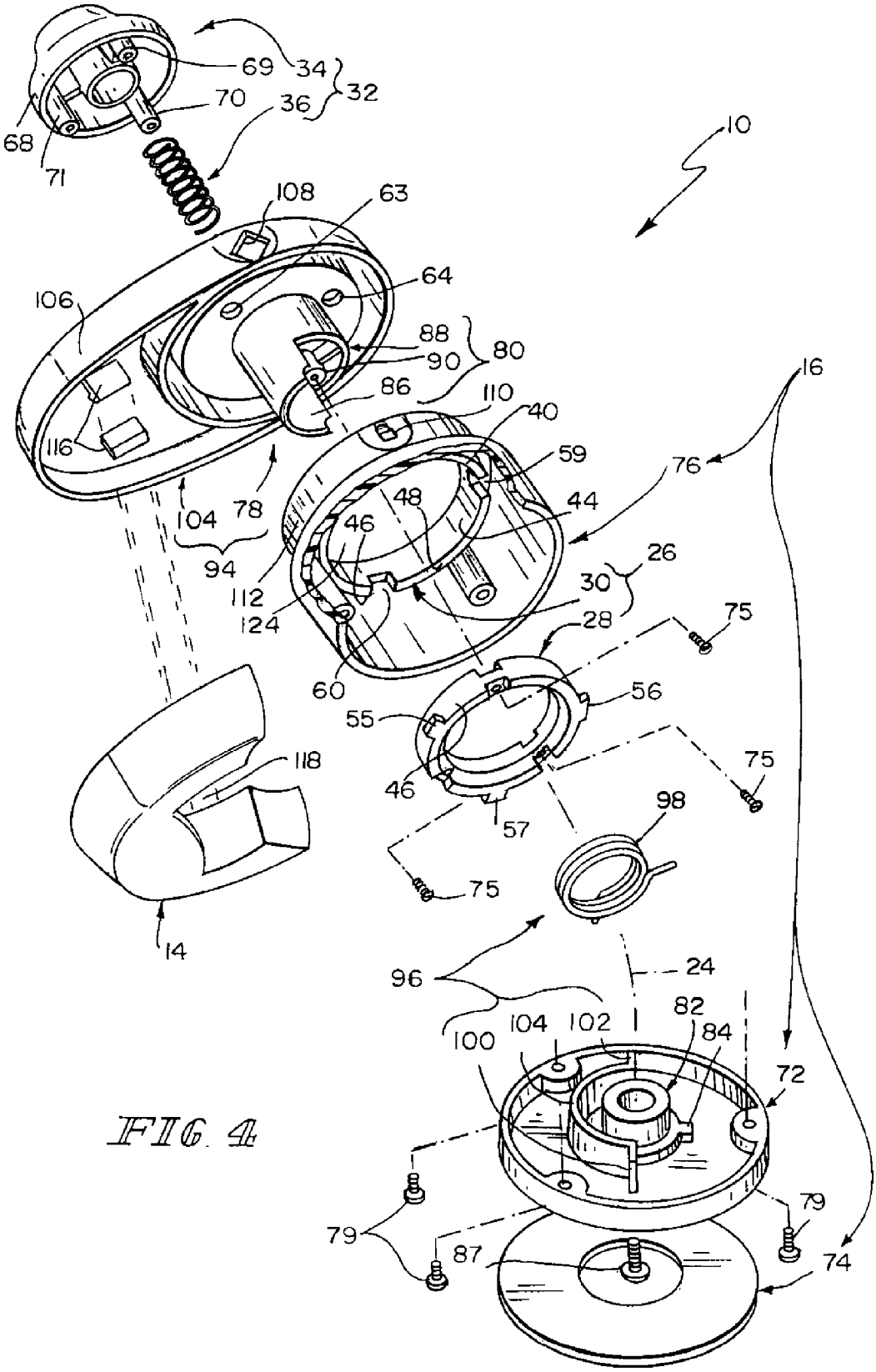
FIG. 4 is an exploded perspective view of the panel lock of FIG. 1, showing that the panel lock includes, from top to bottom, a rotation-lock release button, a button-return spring, a blocker-arm, a blocker jaw configured to be coupled to the blocker-arm, a blocker carrier, a retainer-ring receiver formed in the blocker carrier, a retainer ring, a set of arm-lock fasteners configured to couple the retainer ring to the rotation-lock release button, a blocker-return spring, a carrier foundation, a set of carrier-foundation fasteners configured to couple the blocker carrier to the carrier foundation, a foundation fastener configured to couple the carrier foundation to an article frame, and a pivot fastener configured to couple the carrier foundation to the blocker-arm and also to allow the blocker-arm to rotate relative to the carrier foundation.

Blocker-arm anchor 22, as suggested in FIG. 1 and shown in FIG. 4, includes a rotation lock 26 which includes a retainer ring 28 and a retainer-ring receiver 30. Retainer ring 28 is coupled to panel-movement blocker 20 and is configured to move from a rotation-blocking position, shown in FIGS. 6 and 7, toward a rotation-unblocking position, shown in FIGS. 9, 10, 12, and 13. When rotation lock 26 is in the rotation-blocking position, retainer ring 28 is arranged to mate with retainer-ring receiver 30 that is appended to blocker-support base 16. When retainer ring 28 is in the rotation-unblocking position, retainer ring 28 is positioned to lie in spaced-apart relation to retainer-ring receiver 30.

Figure 8:
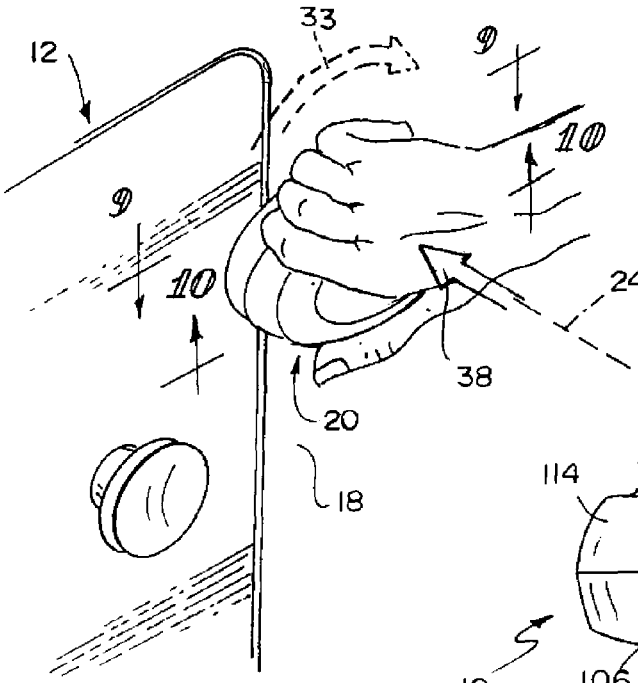
Figure 11:
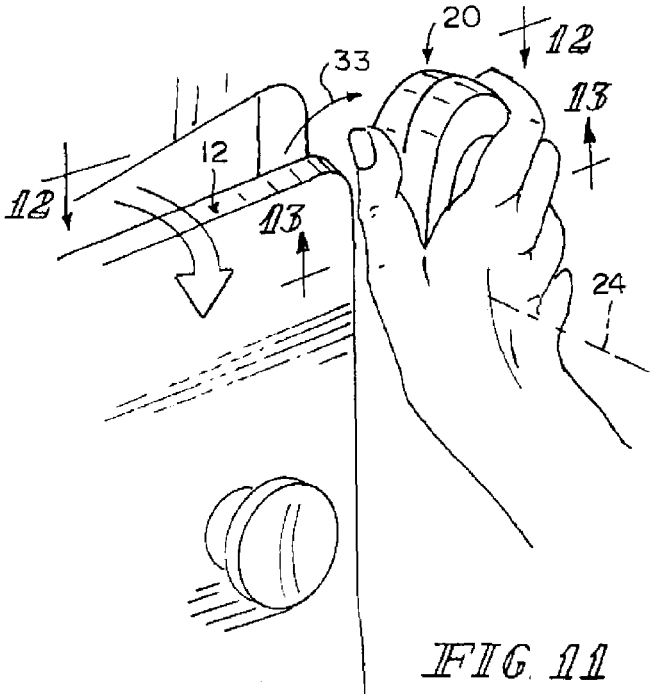
Figure 12:
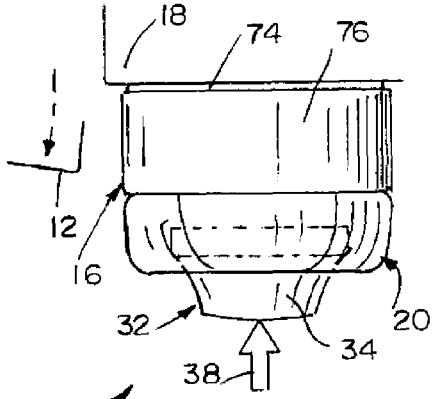
Figure 13:
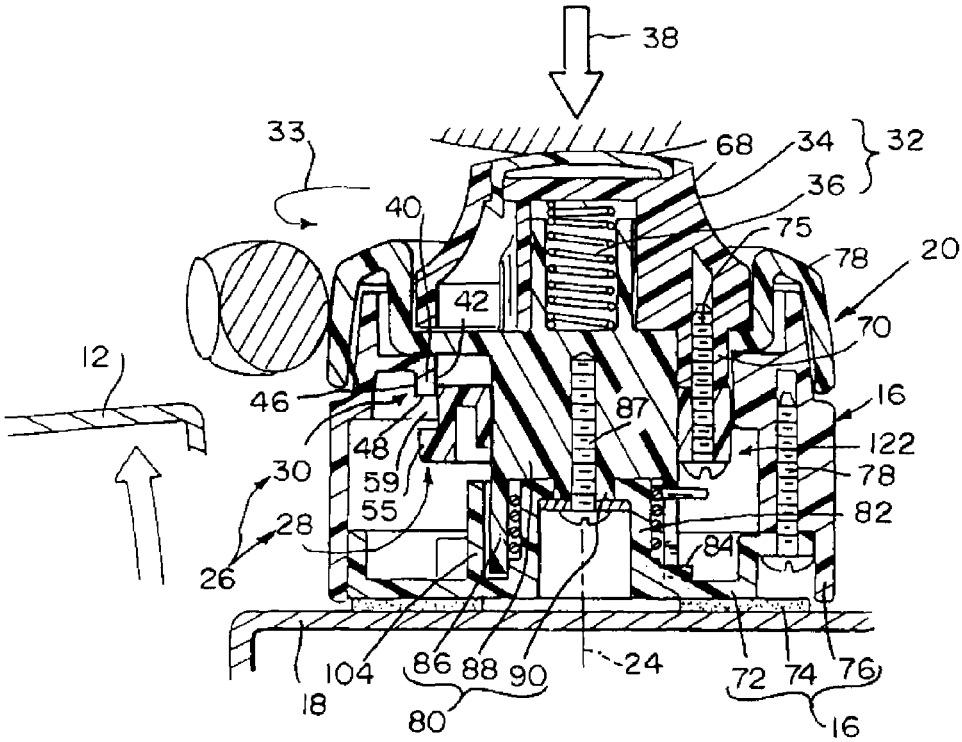
Figure 14:
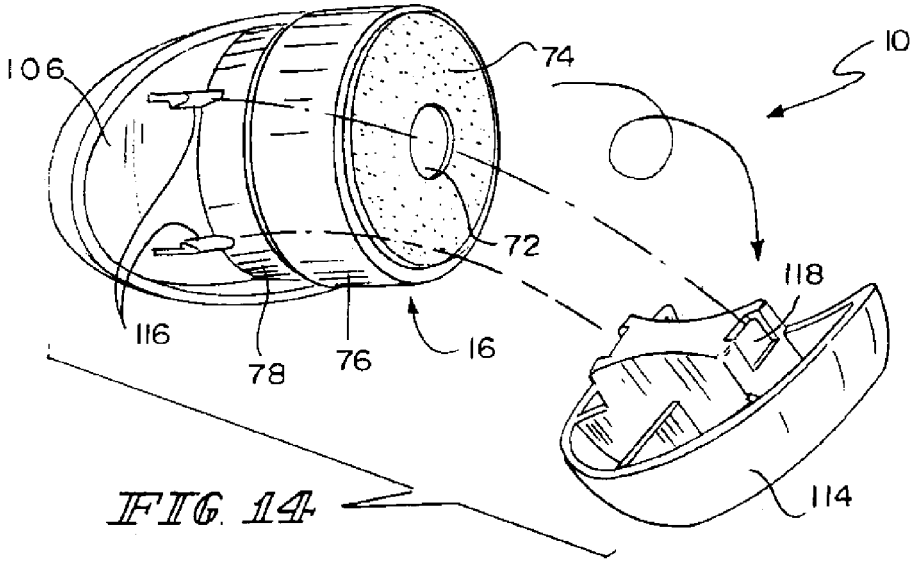
FIG. 14 is a partly exploded perspective view of the panel lock of FIG. 1 showing that the panel lock may be reconfigured in the field by a user by removing the blocker jaw from the blocker-arm so that the panel lock may be mounted on a frame to block movement of a raised-face panel as illustrated in FIGS. 15 and 18.

Blocker-arm anchor 22 further includes a rotation-lock actuator 32 configured to provide means for moving retainer ring 28 out of mating contact with retainer-ring receiver 30 to free panel-movement blocker 20 to rotate about rotation axis 24 in response to a user-applied rotation torque 33 applied during movement of panel-movement blocker 20 from the panel-locking position toward the panel-unlocking position as shown in FIGS. 8, 11, and 13.

Rotation-lock actuator 32 includes a rotation-lock release button 34 and a button-return spring 36 as shown in FIG. 4. Rotation-lock release button 34 is coupled to panel-movement blocker 20 to rotate about rotation axis 24 with panel-movement blocker 20. Rotation-lock release button 34 is coupled to retainer ring 28 to move as a unit from the rotation-blocking position toward the rotation-unblocking position by moving in an actuation direction 38 parallel to rotation axis 24 toward blocker-support base 16 as shown in FIGS. 9 and 10. Button-return spring 36 is arranged to provide a biasing force to rotation-lock release button 34 to urge rotation-lock release button 34 to assume the rotation-blocking position.

As shown in FIGS. 4, 7, 10, and 13 retainer-ring receiver 30 includes a circular band 40 appended to blocker-support base 16. Circular band 40 is arranged to extend away from panel-movement blocker 20 and to include an inner-bearing surface 42, an outer-band surface 46, and a retainer-ring rotation surface 48. Inner-bearing surface 42 positioned to lie a first distance 43 from rotation axis 24 and is arranged to face toward rotation axis 24. Outer-band surface 46 is positioned to lie a relatively larger second distance 44 from rotation axis 24 and is arranged to face away from rotation axis 24. Retainer-ring rotation surface 48 is arranged to extend between inner-bearing surface 42 and outer-band surface 46 and is arranged to face away from panel-movement blocker 20.

Retainer ring 28 of rotation lock 26 is formed to include an inner-ring surface 50 and an outer-ring surface 52 as shown in FIGS. 4, 7, 10, and 13. Inner-ring surface 50 is positioned to lie a third distance 53 from rotation axis 24 and is arranged to face toward rotation axis 24. Outer-ring surface 52 is positioned to lie a relatively larger fourth distance 54 from rotation axis 24 and is arranged to face away from rotation axis 24. Illustratively, outer-ring surface 52 of retainer ring 28 is arranged to lie in confronting relation with inner-bearing surface 42 of retainer-ring receiver 30 upon movement of retainer ring 28 to the rotation-blocking position as shown in FIG. 7.

Retainer ring 28 also includes a first blocking tab 55, a second blocking tab 56, and a third blocking tab 57 as shown in FIG. 4. Each blocking tab 55, 56, 57 is appended to outer-ring surface 52 and is arranged to extend away from rotation axis 24. Second blocking tab 56 is positioned to lie in spaced-apart relation to first blocking tab 55 and third blocking tab 57 is positioned to lie in spaced-apart relation from first and second blocking tabs 55, 56. Illustratively, blocking tabs 55, 56, 57 are positioned in circumferentially spaced-apart relation to one another at 120 degree intervals around retainer ring 28.

Illustratively, retainer-ring receiver 30 is formed to include a first tab-receiving notch 59, a second tab-receiving notch 60, and a third tab-receiving notch 61 as shown in FIG. 4. Each tab-receiving notch 59, 60, 61 is arranged to receive each companion blocking tab 55, 56, 57 appended to retainer ring 28 upon movement of retainer ring 28 to the rotation-blocking position as shown in FIG. 7. Upon movement of retainer ring 28 to the rotation-unblocking position as shown in FIGS. 10 and 13, each blocking tab 55, 56, 57 is arranged to ride on retainer-ring rotation surface 48 as panel-movement blocker 20 moves from the panel-locking position (FIG. 10) toward the panel-unlocking position (FIG. 13).

As shown in FIG. 4 and suggested in FIGS. 7, 10, and 13, panel-movement blocker 20 is formed to include illustratively a first post-receiving aperture 63, a second-post-receiving aperture 64, and a third post-receiving aperture 65. Each post-receiving aperture 63, 64, 65 is positioned to lie a first radial distance 66 from rotation axis 24. Rotation-lock release button 34 of rotation-lock actuator includes illustratively a button grip 68, a first button post 69, a second button post 70, and a third button post 71. Each button post 69, 70, 71 is appended to button grip 68 and arranged to extend through each companion post-receiving aperture 63, 64, 65 and couple to retainer ring 28. Illustratively, retainer ring 28 is coupled to post-receiving apertures 63, 64, 65 by a set of arm-lock fasteners 75.

Blocker-support base 16 of lock 10 includes a carrier foundation 72, a foundation fastener 74, and a blocker carrier 76. Foundation fastener 74 is adapted to interconnect carrier foundation 72 to article frame 18 in a stationary position. Illustratively foundation fastener 74 is a double-sided adhesive pad, but any other suitable alternative may be used. Blocker carrier 76 is coupled to carrier foundation 72 by a set of carrier-foundation fasteners 79, illustratively screws, but any other suitable alternative may be used and blocker carrier 76 is configured to support panel-movement blocker 20.

Panel-movement blocker 20, as shown in FIG. 4, operates to block movement of panel 12 between the opened position and the closed position. Illustratively panel-movement blocker 20 includes an arm-support hub 78 and an arm pivot 80. Arm-support hub 78 is arranged to extend toward carrier foundation 72 and arm pivot 80 is coupled arm-support hub 78. Arm pivot 80 is arranged to extend along rotation axis 24 toward carrier foundation 72. Arm-support hub 78 is configured to mate with blocker carrier 76 to allow rotation of arm-support hub 78 relative to blocker carrier 78.

Arm pivot 80, as shown in FIG. 4, includes a support shaft 88, a pivot axle 90, and a rotation-stop wall 86. Support shaft 88 is appended to arm-support hub 78 and is positioned to lie along rotation axis 24. Pivot axle 90 is appended to support shaft 88 and positioned to lie along rotation axis 24. Rotation-stop wall 86 is appended to support shaft 88 and arranged to extend toward carrier foundation 72. Rotation-stop wall 86 is positioned to lie in spaced-apart relation to pivot axle 90 to define an arm-pivot-receiver space 92 therebetween.

As shown in FIGS. 4, 7, 10, and 13, carrier foundation 72 illustratively includes an arm-pivot receiver 82 arranged to extend toward panel-movement blocker 20 to mate with arm pivot 80 and a blocker-stop tab 84. Arm-pivot receiver 82 and arm pivot 80 cooperate to cause panel-movement blocker 20 to rotate about rotation axis 24 upon movement of rotation lock 26 the rotation-blocking position to the rotation-unblocking position. Blocker-stop tab 84 is appended to arm-pivot receiver 82 and is arranged to extend away from rotation axis 24. Blocker-stop tab 84 is configured to mate with rotation-stop wall 86 included in arm pivot 80 to block rotation of panel-movement blocker 20 after moving to the panel-unlocking position.

Carrier foundation 72 further includes a pivot fastener 87 as shown in FIGS. 4, 7, 10, and 11. Pivot fastener 87 interconnects are pivot 82 and arm-pivot receiver together to allow rotation of blocker are 94 to rotate about rotation arm 24 relative to carrier foundation 72.

Panel-movement blocker 20, as shown in FIG. 4, further includes a blocker-arm 94 and blocker-return means 96 for providing a biasing torque to blocker-arm 94 to cause blocker-arm 94 to move from the panel-unlocking position shown in FIG. 11 toward the panel-locking position shown in FIGS. 3 and 5 so that rotation-lock actuator 32 can move retainer ring 28 from the rotation-unblocking position as shown in FIGS. 10 and 13 toward the rotation-blocking position shown in FIG. 7.

Blocker return 96 operates to bias panel-movement blocker 20 to the panel-locking position after movement by a user to the panel-unlocking position. Blocker return 96 includes a blocker-return spring 98, a clockwise-stop wall 100, and a counter-clockwise stop wall 102. Clockwise-stop wall 100 and counter-clockwise-stop wall 102 are appended to a semicircular pivot guide wall 104. As shown in FIG. 4, counter-clockwise-stop wall 102 is appended to a first end of pivot guide wall 104 and clockwise-stop wall 100 is appended to an opposite second end of pivot guide wall 104. Both counter-clockwise-stop wall 102 and clockwise-stop wall 100 are configured to mate with blocker-return spring 98 when panel-movement blocker 20 is in the panel-unblocking position.

Blocker arm 94 illustratively includes arm-support hub 78 and a blocker appendage 106 as shown in FIG. 4. Blocker appendage 106 is appended to arm-support hub 78 to move therewith. Blocker appendage 106 is arranged to extend away from rotation axis 24 and toward panel 12 when panel-movement blocker 20 is in the panel-blocking position as shown in FIG. 1.

Illustratively, as shown in FIG. 1, arm-support hub 78 is formed to include a lock-status window 108 configured to allow a user to view lock-status indicia formed on blocker carrier 76. Illustratively, lock-status indicia are painted onto blocker carrier 76. Lock-status indicia include a color-coded locked status icon 110 and a color-coded unlocked status icon 112. Color-coded locked status icon 110 is illustratively green and has a closed lock which is visible when panel-movement blocker 20 is in the panel-locking position as shown in FIG. 1. The color-coded unlocked status icon 112 is illustratively red and visible when panel-movement blocker 20 is in the panel-unlocking position as suggested in FIG. 11.

Arm-support hub 78 of panel-movement blocker 20 is formed to include first post-receiving aperture 63, second-post-receiving aperture 64, and third post-receiving aperture 65 as shown in FIG. 4. Each post-receiving aperture 63, 64, 65 is positioned to lie first radial distance 66 from rotation axis 24. Illustratively, each post-receiving aperture 63, 64, 65 arranged such that a central angle of 120 degrees is formed between each of the post-receiving apertures 63, 64, 65.

Figure 15:
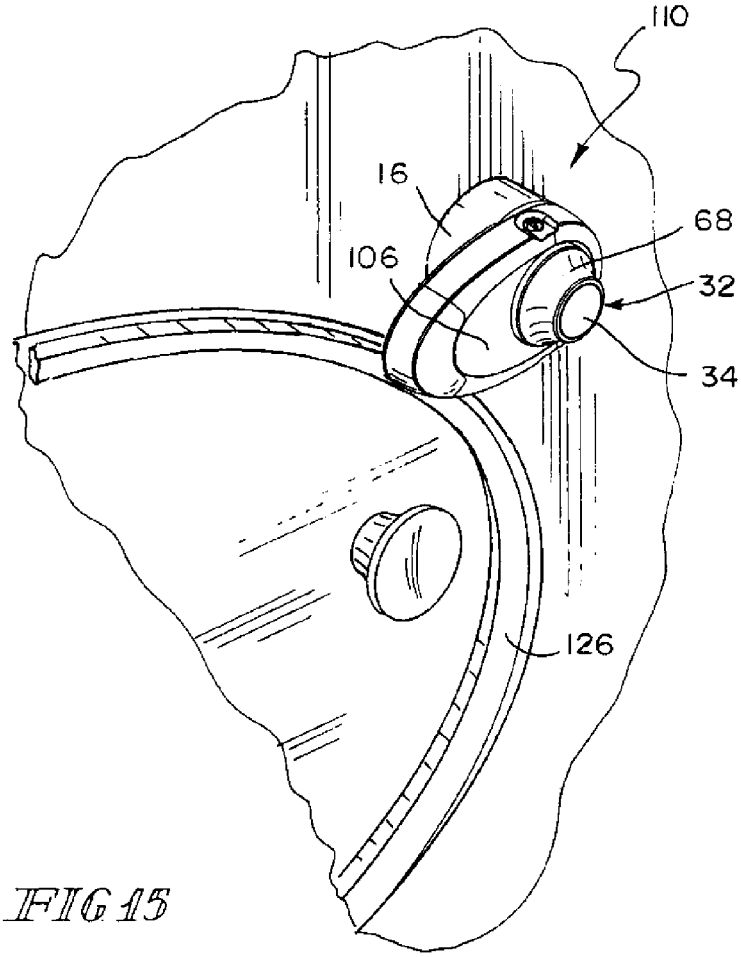
FIG. 15 is a partial perspective view of the of the panel lock of FIG. 14 showing the re-configured panel lock mounted to a frame and configured to block movement of the raised-face panel.
Figure 16:
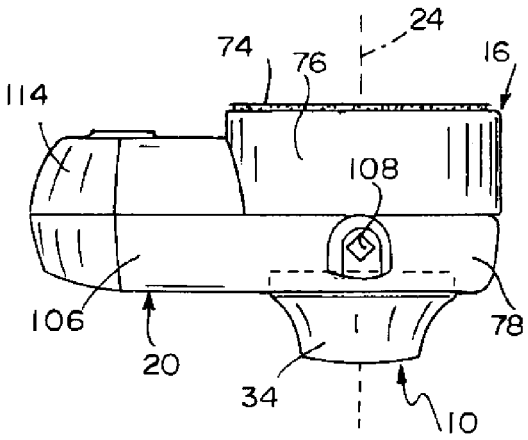
FIG. 16 is a plan view of the panel lock of FIG. 1 showing the panel lock prior to being reconfigured for use with the raised-face panel as illustrated in FIGS. 15 and 18.
Figure 17:
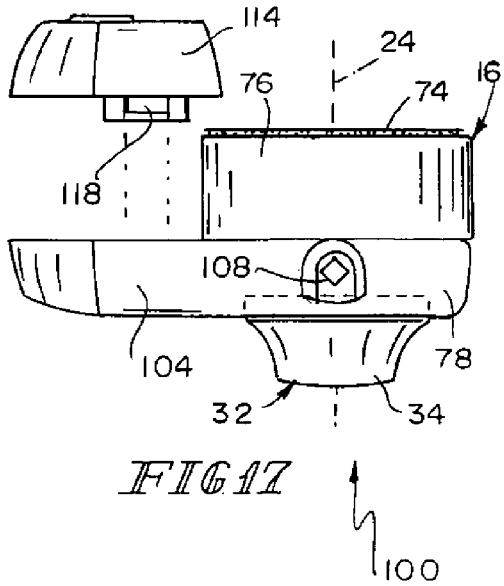
FIG. 17 is a plan view of the panel lock of FIG. 14 showing that the panel lock has been reconfigured for mounting on a raised-face panel by separating the blocker jaw from the blocker-arm.
Figure 18:
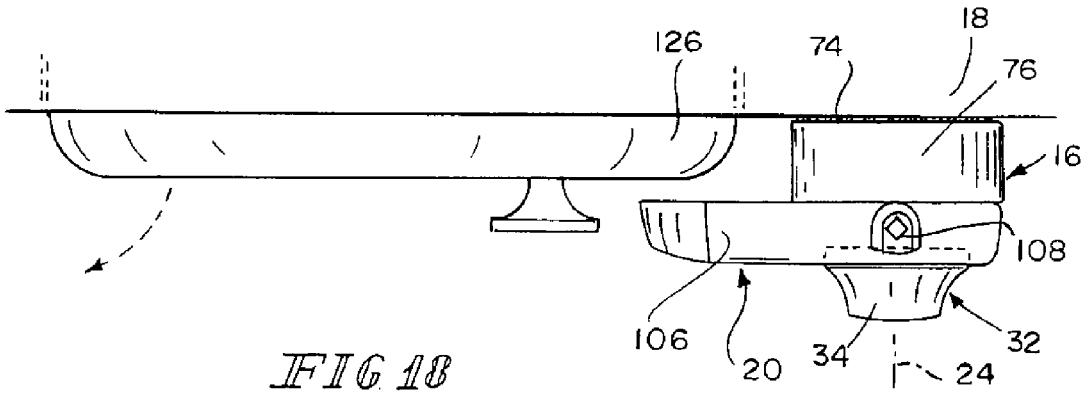
FIG. 18 is plan view of the panel lock of FIG. 14 showing that the panel lock, after reconfiguration, may be mounted to a frame to block movement of a raised-face panel.

As shown in FIGS. 1 and 14-18, panel-movement blocker 20 further includes a blocker jaw 114 which is used with panel 12 and removed for use with raised-face panel 126. Blocker jaw 114 is detachably coupled to blocker-arm 94 to move therewith. Blocker jaw 114 is positioned to lie in spaced-apart relation to rotation axis 24 and is arranged to extend toward panel 12 of article 14. Illustratively, blocker jaw 114 may be removed from blocker-arm 94 so that panel lock 10 may be used with a raised-face panel 126 as shown in FIGS. 15 and 18. Panel lock 10 is still fixed to article frame 18 of article 14 to prevent opening and closing of raised-face panel 126 relative to article frame 18.

As shown in FIGS. 16 and 17, blocker-arm 94 includes arm-support hub 78 and blocker appendage 106. Illustratively, blocker jaw 114 is coupled to blocker appendage 106. Blocker appendage 106 includes a pair of retainers 116 extending toward article frame 18. Blocker jaw 114 includes a companion pair of retainer receivers 118 configured to receive retainers 116 when blocker jaw 114 is coupled to blocker appendage 106.

As shown in FIG. 1 panel-lock 10 for a panel 12 is mounted on an article 14 and includes blocker-support base 16, panel-movement blocker 20, and blocker-arm anchor 22. Blocker-support base 16 is adapted to mount on article frame 18 in a stationary position near panel 12. Panel-movement blocker 20 includes blocker-arm 94 and a blocker jaw 114. Blocker-arm 94 is mounted on blocker-support base 16 to rotate about rotation axis 24 between the panel-locking position and the panel-unlocking position. Blocker jaw 114 is detachably coupled to blocker-arm 94 to move therewith.

Blocker-arm anchor 22 includes rotation lock 26 and a rotation-lock actuator 32. Rotation lock 26 is coupled to blocker-arm 94 and configured to move from the rotation-blocking position wherein the rotation lock is arranged to interconnect blocker arm 94 and blocker-support base 16 toward the rotation-unblocking position wherein rotation lock 26 is positioned to lie in spaced-apart relation to blocker-arm 94 to allow panel-movement blocker 20 to rotate about rotation axis 24 in response to application of user-applied rotation torque 33 to panel-movement blocker 20. Rotation-lock actuator 32 is coupled to blocker-arm 94 to move relative to blocker-support base 16 and to rotation lock 26 to move rotation lock 26.

Blocker-support base 16, as shown in FIG. 4, includes carrier foundation 72, foundation fastener 74, and blocker carrier 76. Blocker carrier 76 and carrier foundation 74 cooperate to a define rotation-lock space 122 therebetween. Illustratively, rotation lock 26 is positioned to lie within rotation-lock space 122 as shown in FIGS. 7, 10, and 13. Blocker carrier 76 is formed to include an arm-pivot aperture 124 as shown in FIG. 5. Arm-pivot aperture 124 opens into rotation-lock space 122. Illustratively, arm pivot 80 of blocker-arm 94 is arranged to extend through arm-pivot aperture 124 toward carrier foundation 72 to mate with arm-pivot receiver 82 of carrier foundation 72.

Illustratively, panel-movement blocker 20 includes a blocker-return spring 98. Blocker-return spring 96 is configured to provide a biasing torque to blocker-arm 94 to cause blocker-arm 94 to move from the panel-unlocking position toward the panel-locking position after removal of user-applied rotation torque 33. Blocker-return spring 96 is mounted to wrap around arm-pivot receiver 82 of carrier foundation 72.

Panel lock 10 may be used illustratively to block opening and closing of panel doors on front load washers and dryers. Panel lock 10 includes a blocker-return spring 96 which cooperates with carrier foundation 72 and blocker-arm 94 to bias blocker arm 94 into the panel-locking position shown in FIGS. 1 and 3. After blocker arm 94 is moved to the panel-unlocking position and the panel door is moved to the opened position, if blocker-arm 94 is released, blocker-return spring 96 will urge blocker arm 94 to return to the panel-locking position thus blocking the movement of the panel door from the opened position to the closed prevention. Illustratively front load washers and dryers equipped with door interlocks will not be able to be started with blocker-arm 94 blocking closing movement of the panel door.

The invention claimed is:

1. A lock for a panel mounted on an article, the lock comprising a blocker-support base adapted to mount on an article frame in a fixed position near the panel, a panel-movement blocker mounted on the blocker-support base to rotate about a rotation axis between a panel-locking position wherein the panel-movement blocker is adapted to block movement of the panel mounted on the article to keep the panel in mating contact with the article and a panel-unlocking position wherein the panel-movement blocker is adapted to allow movement of the panel to move out of mating contact with the article, and a blocker-arm anchor including a rotation lock including a retainer ring and a retainer-ring receiver, the retainer ring being coupled to the panel-movement blocker and configured to move relative to the panel-movement blocker and the blocker-support base from a rotation-blocking position wherein the retainer ring is arranged to mate with the retainer-ring receiver appended to the blocker-support base toward a rotation-unblocking position wherein the retainer ring is positioned to lie in spaced-apart relation to the retainer-ring receiver, and actuator means for moving the retainer ring out of mating contact with the retainer-ring receiver to free the panel-movement blocker to rotate about the rotation axis in response to a rotation torque applied during movement of the panel-movement blocker from the panel-locking position toward the panel-unlocking position.

2. The lock of claim 1, wherein the actuator means includes a rotation-lock release button coupled to the panel-movement blocker to rotate about the rotation axis therewith and the rotation-lock release button is coupled to the retainer ring to move as a unit from the rotation-blocking position toward the rotation-unblocking position by moving in an actuation direction parallel to the rotation axis toward the blocker-support base and a button-return spring arranged to provide a biasing force to the rotation-lock release button to urge the rotation-lock release button to assume the rotation-blocking position.

3. The lock of claim 2, wherein the retainer-ring receiver includes a circular band appended to the blocker-support base and arranged to extend away from the panel-movement blocker and the circular band is formed to include an inner-bearing surface positioned to lie a first distance from the rotation axis and arranged to face toward the rotation axis, an outer-band surface positioned to lie a relatively larger second distance from the rotation axis and arranged to face away from the rotation axis, and a retainer-ring rotation surface arranged to extend between the inner-bearing surface and the outer-band surface and arranged to face away from the panel-movement blocker.

4. The lock of claim 3, wherein the retainer ring is formed to include an inner-ring surface positioned to lie a third distance from the rotation axis and arranged to face toward the rotation axis, an outer-ring surface positioned to lie a relatively larger fourth distance from the rotation axis and arranged to face away from the rotation axis, and the outer-ring surface of the retainer ring is arranged to lie in confronting relation with the inner-bearing surface of the retainer-ring receiver upon movement of the retainer ring to the rotation-blocking position.

5. The lock of claim 4, wherein the retainer ring includes a first blocking tab appended to the outer-ring surface of the retainer ring, the first blocking tab is arranged to extend away from the rotation axis and a second blocking tab is appended to the outer-ring surface and positioned to lie in spaced-apart relation to the first blocking tab, the second blocking tab is arranged to extend away from the rotation axis.

6. The lock of claim 5, wherein the retainer-ring receiver is formed to include a first tab-receiving notch arranged to receive the first blocking tab upon movement of the retainer ring to the rotation-blocking position and a second tab-receiving notch arranged to receive the second blocking tab upon movement of the retainer ring to the rotation-blocking position.

7. The lock of claim 2, wherein the panel-movement blocker is formed to include a first post-receiving aperture positioned to lie a first radial distance from the rotation axis.

8. The lock of claim 7, wherein the rotation-lock release button includes a button grip and a first button post appended to the button grip and arranged to extend through the first post-receiving aperture and the first button post is coupled to the retainer ring.

9. The lock of claim 2, wherein the blocker-support base includes a carrier foundation, a foundation fastener adapted to interconnect the carrier foundation to the article frame, and a blocker carrier coupled to the carrier foundation.

10. The lock of claim 9, wherein the panel-movement blocker includes an arm-support hub mounted on the blocker carrier for rotation about the rotation axis and an arm pivot coupled to the arm-support hub and arranged to extend toward the carrier foundation.

11. The lock of claim 10, wherein the carrier foundation includes an arm-pivot receiver arranged to extend toward the panel-movement blocker and to mate with the arm pivot to cause the panel-movement blocker to rotate about the rotation axis upon movement of the rotation lock from the rotation-blocking position to the rotation-unblocking position and a blocker-stop tab appended to the arm-pivot receiver and arranged to extend away from the rotation axis, the blocker-stop tab is configured to mate with a rotation-stop wall included in the arm pivot to block rotation of the panel-movement blocker after moving to the panel-unlocking position.

12. The lock of claim 11, wherein the arm pivot includes a support shaft appended to the arm-support hub and positioned to lie along the rotation axis, a pivot axle appended the support shaft and positioned to lie along the rotation axis, and the rotation-stop wall appended to the support shaft to extend toward the carrier foundation and positioned to lie in spaced-apart relation to the pivot axle.

13. The lock of claim 1, wherein the panel-movement blocker includes a blocker arm mounted on the blocker-support base to rotate about the rotation axis and blocker-return means for providing a biasing torque to the blocker-arm to cause the blocker-arm to move from the panel-unlocking position toward the panel-locking position so that the actuator means can move the retainer ring from the rotation-unblocking position toward the rotation-blocking position.

14. The lock of claim 13, wherein the blocker arm includes an arm-support hub mounted on the blocker-support base to rotate about the rotation axis and a blocker appendage appended to the arm-support hub to move therewith and the blocker appendage is arranged to extend away from the rotation axis.

15. The lock of claim 14, wherein the arm-support hub is formed to include a first post-receiving aperture, a second post-receiving aperture, and a third post-receiving aperture, the first, second, and third post-receiving apertures are positioned to lie a first radial distance from the rotation axis, and a central angle of about 120 degrees is formed between the first, second, and third post-receiving apertures.

16. The lock of claim 15, wherein the actuator means includes a rotation-lock release button including a button grip and a first button post appended to the button grip and arranged to extend through the first post-receiving aperture to interconnect the retainer ring and the rotation-lock release button.

17. The lock of claim 14, wherein the arm-support hub is formed to include a first post-receiving aperture positioned to lie a first radial distance from the rotation axis.

18. The lock of claim 1, wherein the panel-movement blocker includes a blocker arm coupled to the blocker-support base to rotate about the rotation axis relative to the blocker-support base and a blocker jaw coupled detachably to the blocker-arm to move therewith and the blocker jaw is positioned to lie in spaced-apart relation to the rotation axis and is arranged to extend toward the panel of the article.

19. The lock of claim 18, wherein the blocker-arm includes an arm-support hub mounted on the blocker-support base to rotate about the rotation axis and a blocker appendage appended to the arm-support hub to move therewith and the blocker jaw is coupled detachably to the blocker appendage.

20. The lock of claim 19, wherein the blocker-arm further includes an arm pivot appended to the arm-support hub and arranged to extend toward the article frame to mate with an arm-pivot receiver included in the blocker-support base.

21. A lock for a panel mounted on an article, the lock comprising a blocker-support base adapted to mount on an article frame in a fixed position near the panel, a panel-movement blocker including a blocker arm mounted on the blocker-support base to rotate about a rotation axis between a panel-locking position and a panel-unlocking position and a blocker jaw coupled to the blocker-arm to move therewith, and a blocker-arm anchor including a rotation lock coupled to the blocker arm, a first portion of the rotation lock being coupled to the blocker-support base, and a second portion of the rotation lock being configured to move relative to the blocker arm and the blocker-support base from a rotation-blocking position wherein the rotation lock is arranged to interconnect the blocker-arm and the blocker-support base toward a rotation-unblocking position wherein the rotation lock is positioned to lie spaced-apart relation to the blocker arm to cause the panel-movement blocker to be freed to rotate about the rotation axis in response to application of a user-applied rotation torque to the panel-movement blocker and a rotation-lock actuator coupled to the blocker arm to move therewith in response to application of a force to the rotation-lock actuator by a user.

22. The lock of claim 21, wherein the blocker-support base includes a carrier foundation, a foundation fastener adapted to interconnect the carrier foundation to the article frame in a fixed position relative to the article frame, and a blocker carrier coupled to the carrier foundation in a fixed position relative to the carrier foundation and arranged to support the panel-movement blocker thereon for movement about the rotation axis.

23. The lock of claim 22, wherein the blocker carrier and the carrier foundation cooperate to define a rotation-lock space therebetween and the rotation lock is positioned to lie within the rotation-lock space.

24. The lock of claim 23, wherein the blocker carrier is formed to include an arm-pivot aperture opening into the rotation-lock space and wherein the blocker-arm includes an arm-support hub mounted on the blocker carrier to rotate about the rotation axis and an arm pivot coupled to the arm-support hub and arranged to extend through the arm-pivot aperture toward the carrier foundation.

25. The lock of claim 24, wherein the carrier foundation includes an arm-pivot receiver configured to mate with the arm pivot of the blocker-arm and a blocker-stop tab configured to engage the arm pivot upon movement of the panel-movement blocker to the panel-unlocking position to cause the panel-movement blocker to stop rotating about the rotation axis upon assuming the panel-unlocking position.

26. The lock of claim 24, wherein the panel-movement blocker further includes a blocker-return spring configured to provide a biasing torque to the blocker-arm to cause the blocker-arm to move from the panel-unlocking position toward the panel-locking position and the blocker-return spring is mounted to wrap a round an arm-pivot receiver included in the carrier foundation.

27. A lock for a panel mounted on an article, the lock comprising a blocker-support base, a panel-movement blocker mounted on the blocker-support base to rotate about a rotation axis between a panel-locking position and a panel-unlocking position, and a blocker-arm anchor including a rotation-lock actuator and a rotation lock coupled to the panel-movement blocker, the rotation lock actuator including a first portion coupled to the blocker-support base and a second portion configured to move in a direction parallel to the rotation axis relative to the blocker-support base and the panel-movement blocker from a rotation-blocking position wherein the blocker-arm anchor is arranged to interconnect the panel-movement blocker to the blocker-support base to a rotation-unblocking position wherein the blocker-arm anchor is positioned to lie in spaced-apart relation to the panel-movement blocker to cause the panel-movement blocker to rotate about the rotation axis in response to application of a user-supplied torque to the panel-movement blocker, and the rotation-lock actuator is coupled to the rotation lock to cause the rotation lock to move from the rotation-blocking position to the rotation-unblocking position in response to a force applied by the user to the rotation-lock actuator.

* * * * *